US005299653A

United States Patent [19]

Nebel

[11] Patent Number: 5,299,653

[45] Date of Patent: Apr. 5, 1994

[54] WORK STATION WITH MOBILE ELEVATABLE WORK PLATFORM

[76] Inventor: Kyle J. Nebel, 31053 Shawn Dr., Warren, Mich. 48093

[21] Appl. No.: 5,696

[22] Filed: Jan. 19, 1993

[51] Int. Cl.[5] ..... B66F 11/00

[52] U.S. Cl. ..... 182/63; 182/2; 182/62.5; 182/113; 182/141

[58] Field of Search ..... 182/63, 2, 113, 223, 182/141, 62.5

[56] References Cited

U.S. PATENT DOCUMENTS

| | | | |
|---|---|---|---|
| 619,439 | 2/1899 | Riecke | 182/62.5 |
| 1,718,979 | 7/1929 | Protzeller | 182/62.5 |
| 2,362,170 | 11/1944 | Swaisgood | 182/24 |
| 4,787,111 | 11/1988 | Pacek et al. | 182/113 X |

FOREIGN PATENT DOCUMENTS

| | | | |
|---|---|---|---|
| 662057 | 4/1964 | Italy | 182/2 |
| 9147 | of 1911 | United Kingdom | 182/223 |

*Primary Examiner*—Alvin C. Chin-Shue

[57] ABSTRACT

Disclosed is an apparatus having a work platform comprised of an expandingly extendable basket mounted on an underframe. The basket has a relatively mobile portion that translates out from the underframe and out from a relatively stationary portion of the basket fix to underframe. Mounted to the underframe are rollers engaging beams supporting the relatively mobile portion of the basket, the beams translating on the rollers when the basket expands. The basket is raised and lowered on pivot arms which are connected between the underframe and a base of the apparatus. The position and movement of the arms are controlled by a screw jack fixed to the work platform. An adjustable position stairway is connected between a second, fixed work platform and the first, expandable work platform.

13 Claims, 5 Drawing Sheets

WORK STATION WITH MOBILE ELEVATABLE WORK PLATFORM

GOVERNMENT USE

The invention described herein may be manufactured, used and licensed by or for the U.S. Government for governmental purposes without payment to me of any royalty.

BACKGROUND AND SUMMARY

Vehicles or their components are often mounted on large test stands that simulate conditions of vehicle travel over roads or terrains. Sensors, recording instruments and other test equipment typically need to be placed on the vehicle, and often personnel with their equipment need access to the vehicle periodically during vehicle testing. The vehicles are frequently very difficult to get to while they are on the test stand, especially for personnel carrying large or bulky items to the vehicle.

My invention is a work station that has a moving basket assembly that can be raised or lowered and that can be extended forward to facilitate access to a test vehicle. The work station also has a raised fixed platform connected to the basket by an adjustable position stairway. The stairway can act as a gangway between the fixed platform and the basket so that heavy or bulky equipment can be moved therebetween. One side of the fixed platform has a removable barrier so that heavy equipment can be lifted onto the fixed platform by such means as a fork lift truck.

BRIEF DESCRIPTION OF THE DRAWINGS

FIG. 4 also shows an example of a floor grate element that is part of a relatively mobile basket-like subassembly of the basket assembly.

DETAILED DESCRIPTION

Figure 1:
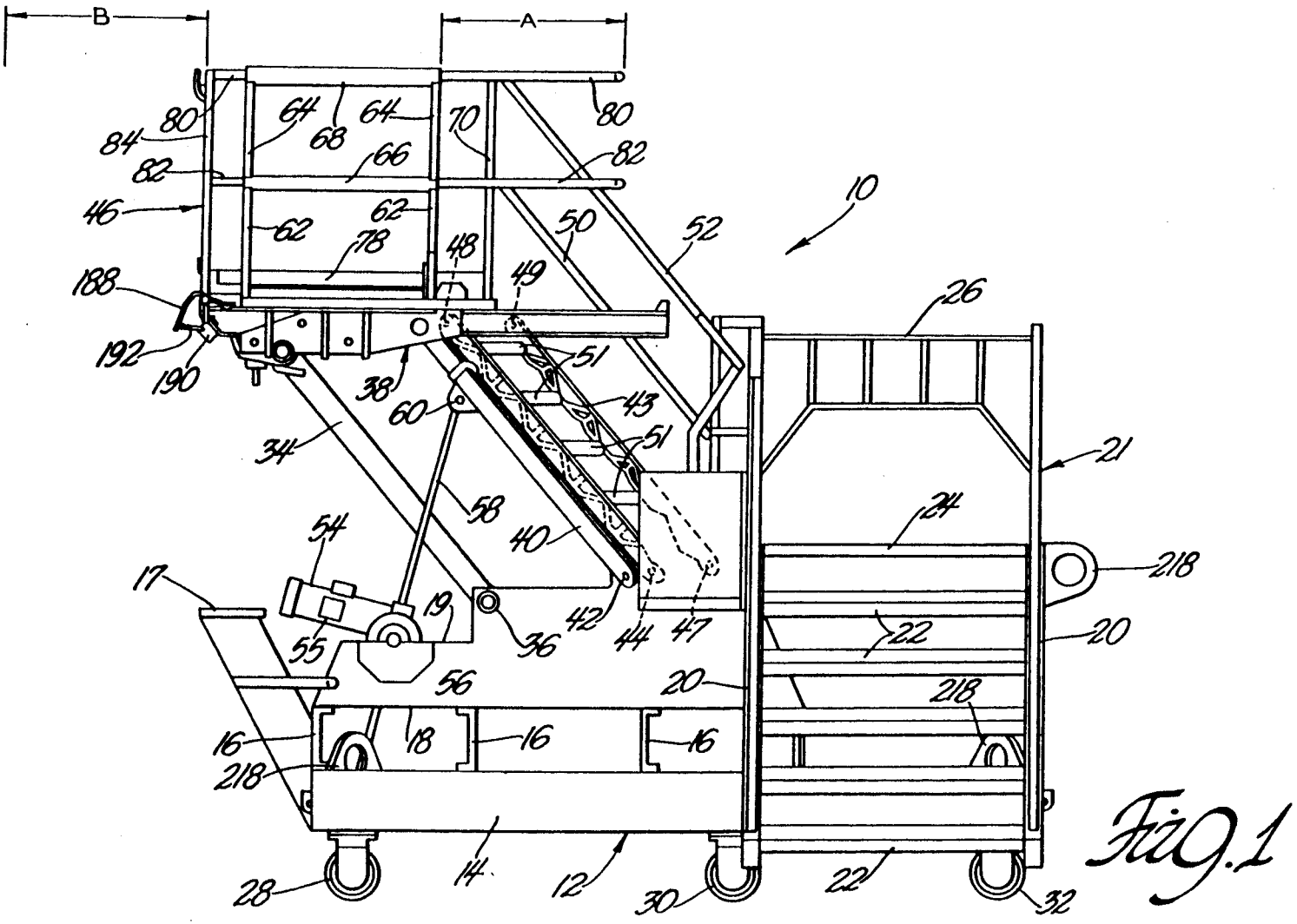
FIG. 1 is a side elevational view of my work station with an elevatable, expandable basket assembly.

Shown in FIG. 1 is mobile work station 10 having a base 12 constructed of heavy formed chassis elements 14 and 18 connected by channels 16. Fixedly attached to the rear of the base is a stairway 21, this stairway being comprised of guard rails 20, steps 22 and landing 24. Between rails 20 at landing 20 is a removable safety barrier 26, which can be a web-like structure formed of lengths of chain disposed between the guard rails at the top of the fixed stairway. It is contemplated that a person standing, lying or kneeling on landing 24 will be able to access a structure or item to be worked on (not shown) on the opposite side of barrier 26 from the person. When barrier 26 is removed, large or heavy pieces of test equipment or other items can be lifted onto platform 24 by a fork lift truck or other suitable means.

Work station 10 has a plurality of eye brackets 218 mounted thereon to serve as attachment points for jacks or fork lift trucks used to raise the entire work station to a desired level. Brackets 218 can also be used as attachment points to anchor work station 10 to a floor, wall or other stationary structure. Attached beneath the forward end of base 12 is a pair of wheel assemblies 28, and a similar pair of wheel assemblies 30 are attached beneath the base 12 near the rearward end of the base, while still another pair of wheel assemblies 32 are attached to the bottom of stairway 21 at the rearward side of the stairway.

Figure 3:
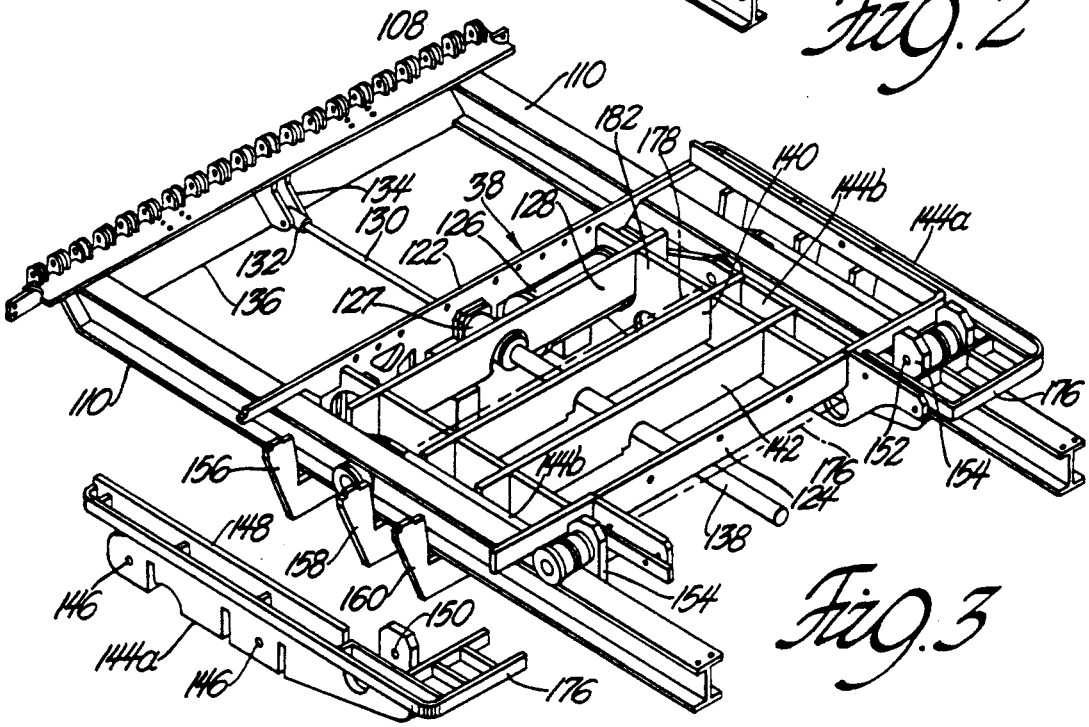
FIG. 3 is perspective view of the underframe of the basket assembly.
Figure 11:
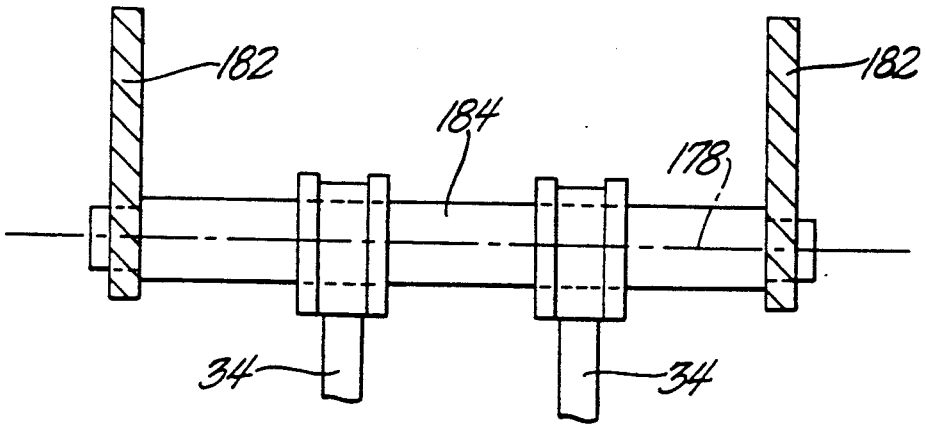
FIG. 11 is a detail view showing a pivotal connection between forward pivot arms and the underframe of the basket assembly.
Figure 12:
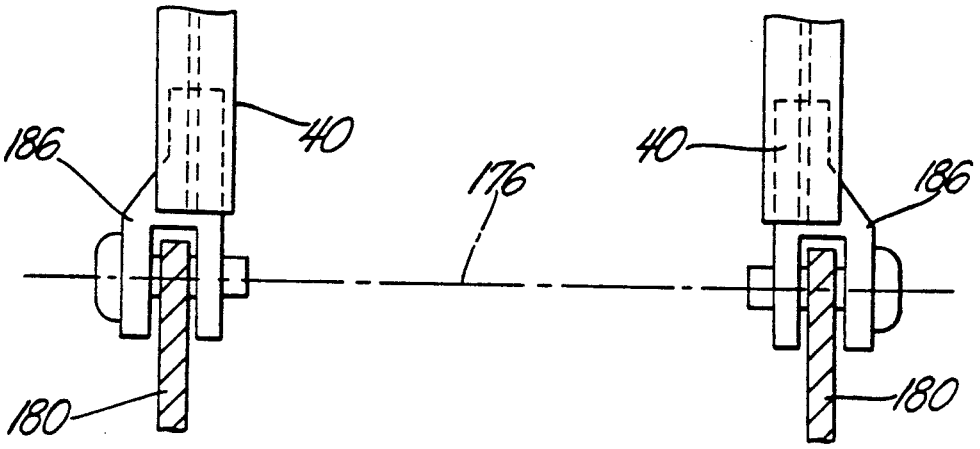
FIG. 12 is a detail view showing a pivotal connection between intermediate pivot arms and the underframe of the basket assembly.

A parallel pair of forward arms 34 are pivotally connected at their lower ends to base 12 via forward journal connections as at 36, and arms 34 are pivotally connected at their upper ends to basket underframe 38 near the front thereof. As seen in FIGS. 3 and 11, the upper ends of arms 34 are connected to rod 184 rotatable on axis 178 and mounted between interstitial frame members 182. A parallel pair of intermediate arms 40 are pivotally connected at their lower ends to base 12 via intermediate journal connections 42, and arms 40 are pivotally connected at their upper ends to platform underframe 38 near the rear thereof. As seen in FIGS. 3 and 12, the upper ends of arms 40 are rotatably connected to clevises 186 about axis 176, the clevises fixed suitably on interstitial frame members 180. A first parallel pair of rearward, stairway arms 41 are pivotally connected to base 12 at their lower ends via journal connections 44 and are pivotally connected at their upper ends at 48 to a part of platform assembly 46 fixed relative to underframe 38. A second pair of parallel rearward, stairway arms are pivotally to base 12 at their lower ends via journal connections 47 and are pivotally connected at their upper ends at 49 to a part of platform assembly 46 fixed relative to underframe 38.

A series of mutually parallel stair steps 51 are swingably connected between first rearward arms 41 and second rearward arms 43, whereby the steps remain parallel as pairs of rearward arms 41 and 43 pivot in unison about their respective axes. Preferably, steps 51 are so connected that they will lie in a common plane when intermediate arms 40 are at or near a horizontal orientation. Steps 51 will then form a gangway between platform 24 and basket assembly 46. Such a set of steps is disclosed in my U.S. patent application, "Adjustable Height Stairway," Ser. No. 07/944,600 filed Sep. 14, 1992 and that application is hereby incorporated by reference. Hand rails 50 and 52 are connected to work platform 10 such that they pivot in unison with arms 41 and 43 and remain parallel to these arms during pivoting.

Rotatably mounted to base 12 by any suitable means is an elongate cylindrical screw jack motor 54, one rotational engagement shown at 56 and another rotational engagement (not shown) being on the opposite side of motor 54 from rotational engagement 56. Motor 54 is perpendicular to and engages a parallel pair of threaded screw shafts 58 that axially translate upon the motor's operation. The upper ends of screw shafts 58 are pivotally connected to brackets 60 fixed to intermediate arms 40. The rotational engagement at 56 and the pivotal connections at brackets 60 permit motor 54 and shafts 58 to angularly adjust their positions as shafts 58 translate to swing intermediate arms 40.

When basket assembly 46 is swung down to its lowest position, assembly 46 will rest on plate 17 and motor 54 will be oriented horizontally such that lower surface 55 of the motor aligns with shoulder 19 on base 12. Motor 54 will also then be parallel to and adjacent to underframe 38, whereby motor 54 is closely sandwiched between underframe 38 and base 12. Motor 54 in its horizontal orientation will intrude negligably, if at all, vertically into gaps or spaces bordered or defined by elements of the underframe or base.

Figure 2:
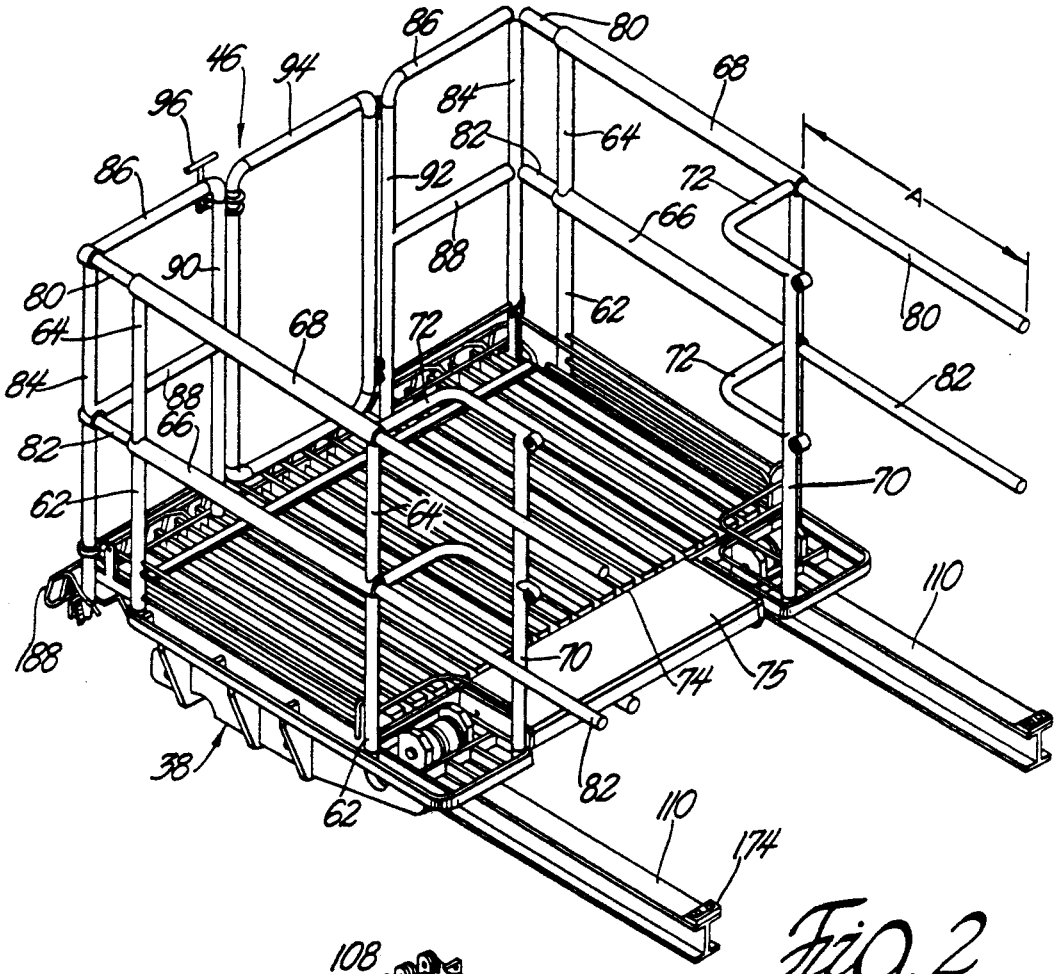
FIG. 2 is a perspective detail view of the basket assembly of the elevational work platform.

Referring now to both FIGS. 1 and 2, basket assembly 46 has a relatively stationary basket-like subassembly which is fixed relative to basket underframe 38. Basket assembly 46 also has a relatively mobile basket-like subassembly that translates relative to underframe 38. In a manner of speaking, the relatively mobile subassembly slidingly telescopes out from the relatively stationary subassembly or telescopingly retracts into the relatively stationary subassembly. The relatively fixed basket-like subassembly includes safety fence sections comprised of lower post segments 62, lower crossbar tubes 66, upper post segments 64, and upper crossbar tubes 68. The safety fence of the relatively fixed subassembly also includes entryway posts 70 and angled bars 72 connected between entryway posts 70 and respective crossbar tubes. The relatively fixed subassembly further includes a floor grid assembly, a version of which is shown at 74 in FIG. 2 and another, preferred version of which is shown at 76 in FIG. 4. Either version of the floor grid assembly will have a step plate 75 welded or otherwise fastened thereto. Additionally, the relatively fixed subassembly includes a section 78 of a mesh-like or grate-like foot barrier most clearly seen in FIGS. 1 and 6, section 78 being attached between the bases of lower post segments 62.

When it translates forward (left in FIG. 1), the relatively mobile basket-like subassembly of basket assembly 46 extends and expands basket assembly 46. The relatively mobile basket-like subassembly has a safety fence comprised of upper slide rails 80 that fit closely and slidingly in upper crossbar tubes 68. Lower slide rails 82 of the relatively mobile subassembly likewise fit closely and slidingly in lower crossbar tubes 66. During the fully retracted position of the relatively mobile subassembly shown in FIGS. 1 and 2, the rearward portions of the slide rails extend a distance "A" out of the crossbar tubes. Distance "A" is at least as long as distance "B", which is the distance the relatively mobile subassembly translates when moving from the fully retracted position to a fully extended position. Thus, during all stages of deployment or retraction of the relatively mobile subassembly, the slide rails will be in full close sliding engagement with the crossbar tubes. Furthermore, the free, rearward ends of the slide rails do not enter the crossbar tubes. The full sliding engagement of the slide rails with the crossbar tubes inhibits tilting or side-to-side skewing of the relatively mobile subassembly with respect to the relatively fixed subassembly and keeps the free ends of the rails from binding inside the crossbar tubes.

The safety fence of the relatively mobile basket-like subassembly further includes corner posts 84 affixed to the forward ends of slide rails 80 and 82. Fixed between corner posts 84 by rail segments 86 and 88 are intermediate posts 90 and 92. A door frame 94 is hinged to post 92 and releasably locked to post 90 by a suitable latch mechanism 96. It may be preferred that a grid or mesh screen (not shown) be placed in door frame 94.

Figure 4:
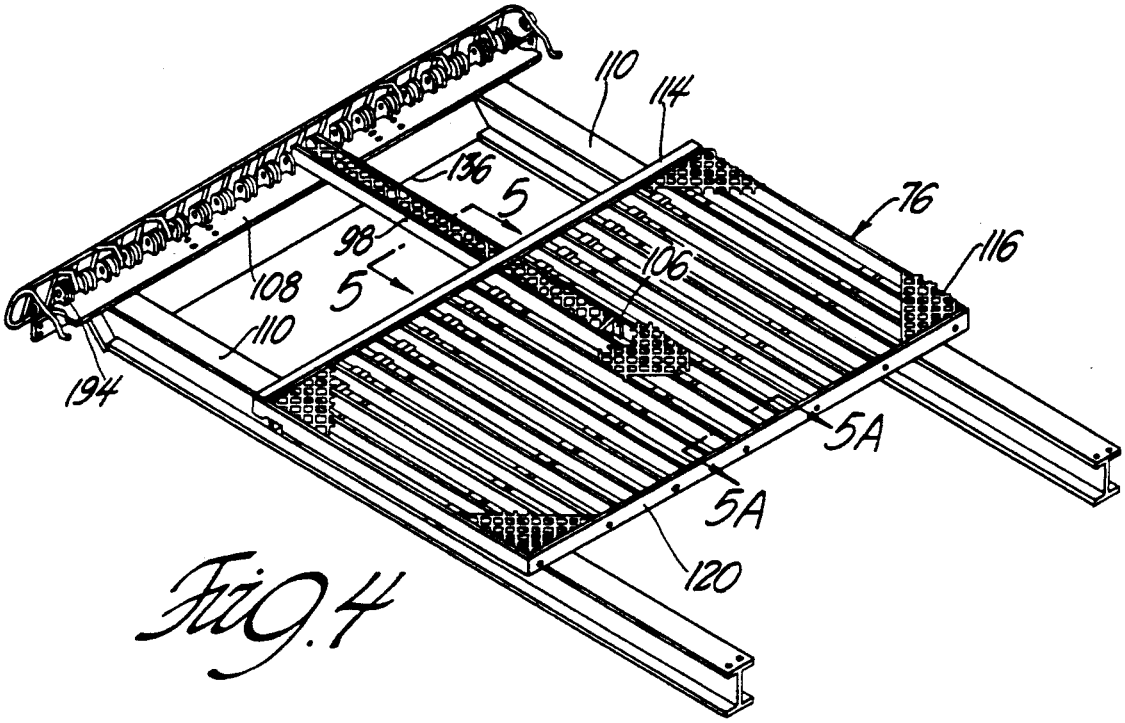
FIG. 4 is a perspective view showing the floor grid assembly that is part of a relatively fixed basket-like subassembly of the basket assembly.
Figure 5:
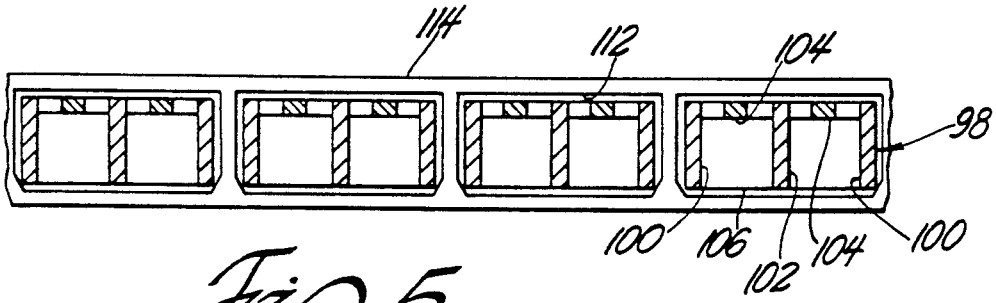
FIG. 5 is a view taken along line 5—5 in FIG. 4.

The floor of the relatively mobile basket-like subassembly is comprised of a set of parallel, spaced apart, elongate floor grate elements, one of which is shown at 98 in FIG. 4. As best seen in FIG. 5, each floor grate element 98 defines a downwardly open double channel configuration having sidewalls 100 formed of flat bars disposed in vertical planes and a midwall 102 parallel to and between sidewalls 100. Connected between midwall 102 and either sidewall 100 to form the webs 104 of the double channel are strips 104 of lattice or screen material. A channel terminus brace 106 is fixed to the sidewalls, midwall and webs at either end of the double channel. Floor grate elements 98 pass through generally rectangular apertures 112 in fore end frame member 114 of floor grid assembly 76, which is fixed to basket underframe 38. As seen in FIG. 4, the floor grate elements 98 are welded or otherwise fixed to a frontal cross piece 108 fixedly connected to parallel I-beams 110, which move relative to underframe 38 and are part of the mobile basket-like subassembly. I-beams 110, cross piece 108 and valence panel 136 form the underlying support frame for the relatively mobile basket-like subassembly.

Figure 5A:
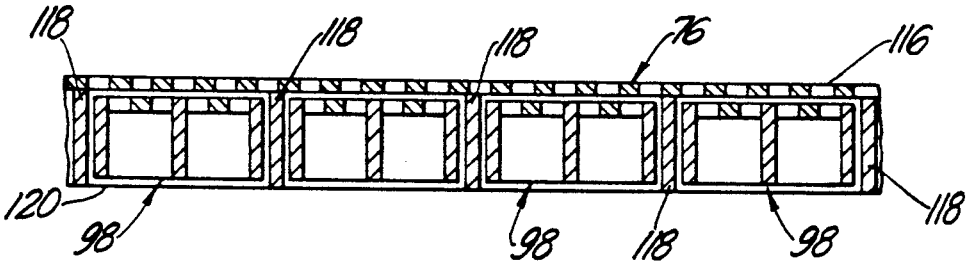
FIG. 5A is a view taken along line 5A—5A in FIG. 4.

The relationship between floor grate elements 98 and floor grid assembly 76 is further illustrated in FIG. 5A, where elements 98 fit in channels of assembly 76. The floor grid assembly channels are defined by a plurality of spaced parallel sidewalls 118 and a grate 116 fixed to the tops of sidewalls 118. Sidewalls 118 run between fore frame member 114 (FIG. 4) of assembly 76 and aft frame member 120 of this assembly. Floor grid assembly 76 preferably does not contact I-beams 110, but instead rests on forward cross member 122 and rearward cross member 124 of basket underframe 38, both of these cross members being shown in FIG. 3.

Referring again to FIG. 3, the means for translating the relatively mobile basket-like subassembly of basket assembly 46 is electric motor 126 fixedly mounted to forward cross member 122 and a neighboring intermediate cross member 128 of basket underframe 38. Translatable by motor 126 via a connection in gear housing 127 is a screw shaft 130. A head 132 of the screw shaft is pivotally engaged by bracket 134 to a valence panel 136 that is fixed to I-beams 110 and frontal cross piece 108. Extending rearward from motor 126 is housing tube 138 in which shaft 130 is closely and slidingly received when the shaft translates rearward. Housing tube 138 passes through intermediate cross members 140 and 142 and may be affixed to these cross members so that shaft 130, tube 138 and motor 126 act as an inner longitudinal brace for basket underframe 38. Screw shaft 130 is disposed no higher and no lower than I-beams 110, valence panel 136 and rearward cross member 124, whereby these latter elements protect screw shaft 130 when basket assembly moves forward or downward past obstacles.

Figure 6:
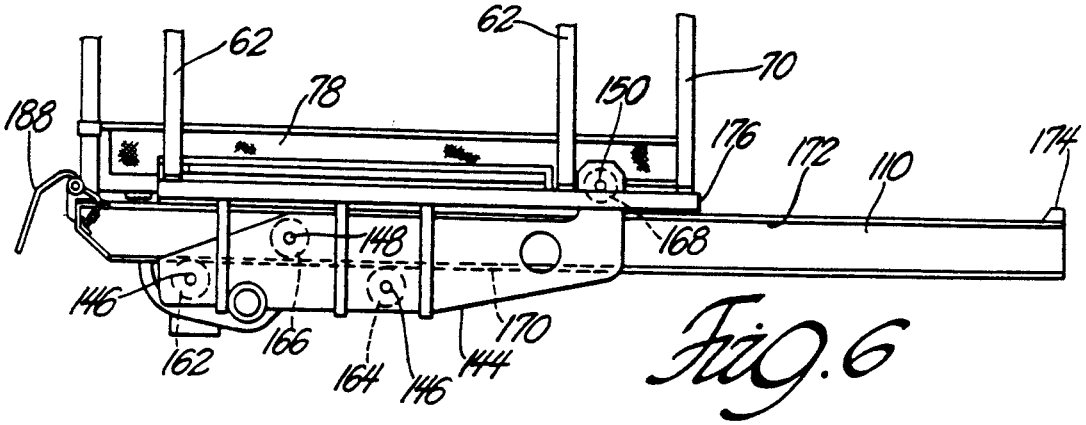
FIG. 6 is a side elevational view of the underframe of the basket assembly showing locations of rollers on the underframe.

Referring now to FIGS. 3 and 6, basket underframe 38 includes roller mounts comprised of external mount elements 144*a* and internal mount elements 144*b*. External mount elements 144*a* are fixed to gussets 156, 158 and 160, which are formed integrally as dog leg elements at the ends of respective intermediate cross members 128, 140 and 142. Internal mount elements 144*b* are fixed to intermediate cross members 128, 140 and 142. The roller mounts not only rotatably hold rollers but they also act as longitudinal stiffening members for underframe 38. As better seen in conjunction with FIGS. 7, 8 and 9, roller mount elements 144*a* and roller mount elements 144*b* define two sets of axially aligned lower mounting holes 146, a set of mediate mounting holes 148 and a terminal mounting hole 150. Terminal hole 150 axially aligns with mounting hole 152 on tab 154 fixed to underframe 38 and preferably fixed to roller mount element 144*a*.

Figure 7:
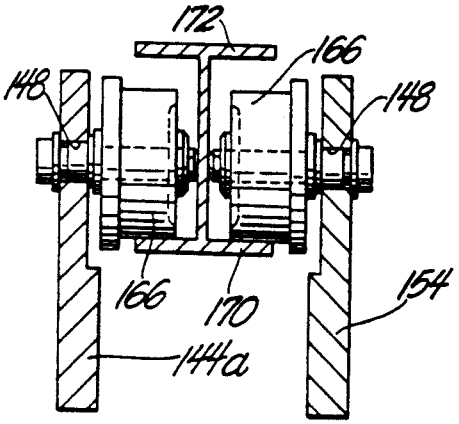
FIGS. 7, 8 and 9 are cross sectional views showing details of the rollers in FIG. 6 and structure for mounting the rollers.
Figure 8:
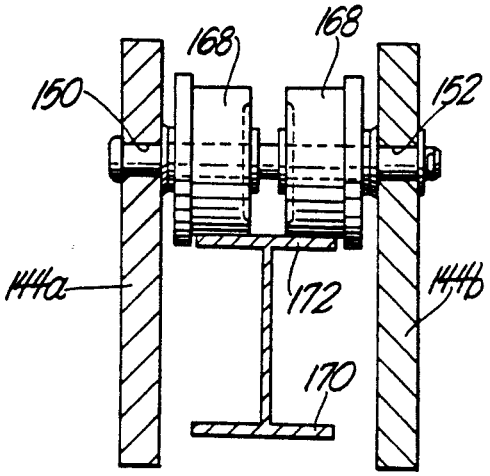
Figure 9:
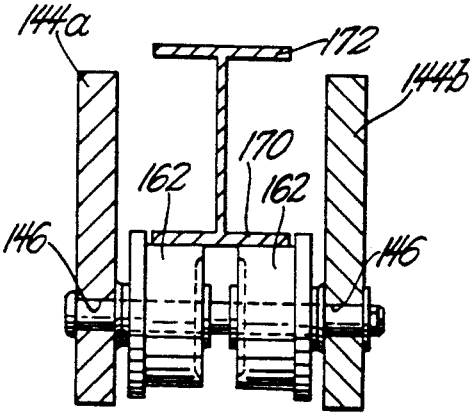

The location of the various sets of rollers on the roller mount elements is perhaps best shown in FIG. 6 in conjunction with FIGS. 7, 8 and 9. Forward rollers 162 and intermediate rollers 164 approximately midway between the ends of mount elements 144*a* and 144*b* engage the undersides of lower flanges 170 of I-beam 110. Interflange rollers 166 are disposed longitudinally midway between rollers 162 and 164, the interflange rollers also being disposed between lower flanges 170 and upper flanges 172 of the I-beam. As shown in FIG. 7, rollers 166 bear on the top surface of lower flange 170. If either end of I-beam 110 attempts to tilt down about respective rollers 162 or 164, then rollers 166 resist the tilt of the I-beam. Rollers 168 are mounted at terminal mounting holes at the rear of the roller mounts and rollers 168 bear on the top of upper flange 172.

It will be recalled that I-beam 110 is an element of the relatively mobile basket-like subassembly of basket assembly 46. Thus, when the relatively mobile subassembly translates forward to extend or expand basket assembly 46, I-beam translates forward, or to the left in FIG. 6 on rollers 162, 164 and 166. I-beam 110 can translate forward from its FIG. 6 position until stop 174 strikes surface 176 of mount element 144. When I-beam 110 is translated fully forward along with the rest of the relatively mobile subassembly, several persons or items can stand on floor grate elements 98 of this subassembly, whereby the forward end of I-beam 110 tends to tilt downward about roller 146. At the same time, the rearward end of I-beam 110 tends to bear upward more forcefully against rollers 168, whereby rollers 168 resist the tendency of the I-beam to tilt. In a manner of speaking, roller 168 exerts an anti-tilting reaction force acting along a moment arm which is the portion of I-beam 110 between the rotational axes of rollers 168 and 162. The disposition of rollers 168 and 162 at opposite ends of roller mount elements 144*a* and 144*b* maximizes the length of the moment arm upon which the reaction force acts, and thereby maximizes the ability of roller 168 to inhibit relative tilting and binding between elements of basket assembly 46. In other words, the juxtaposition of rollers 168 and 162 minimizes tilting and binding between the relatively stationary basket-like subassembly which is fixed relative to basket underframe 38 and the relatively mobile basket-like subassembly that translates relative to underframe 38.

Figure 10:
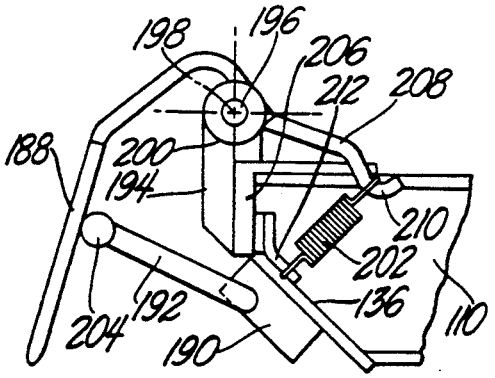
FIG. 10 is a side elevational detail view of a bumper on the basket assembly and a switch operated by the bumper.

FIG. 10 is a detail view showing elements associated with laterally disposed bumper rail 188 mounted to basket assembly 46. In that figure, the forward end of I-beam 110 has a right angle channel 206 mounted to its top above and along valence panel 136. Fixed upon channel 206 is a plurality of apertured brackets 194 (which can also be viewed in FIG. 3) and a slender shaft 196 passes through the apertures of brackets 194. Connected to shaft 196 is bumper rail 188 and apertured disk 200, rail 188 being rotatable about axis 198 of shaft 196. Rail 188 defines a dog leg portion running along and faced towards brackets 194, and at either end of rail 188 is a rearwardly extending finger 208 terminating in hook 210. A tension spring 202 is connected between hook 210 and a spring mount 212 fixed by any suitable means to right angle mount 206 or I-beam 110. Mounted to valence panel 136 is a position sensing switch 190 having pivot arm 192 whose free rolling wheel 204 contacts rail 188.

When motor 126 forwardly translates the relatively mobile subassembly of basket assembly 46, rail 188 contacts obstacles in front of the lower portion of the subassembly. Bumper 188 is then swung counterclockwise (in FIG. 10) toward valence panel 136 by the obstacle. Preferably, rail 188 extends downward lower than switch 190 or I-beam 110 so that the rail 188 strikes the aforementioned obstacles before I-beam 110 or switch 190 strikes them. Preferably also, tension of spring 202 is just sufficient to prevent rail 188 from swinging counterclockwise downward under its own weight, so that spring 202 has little affect on the movement of rail 188 by the obstacle. The counterclockwise swing of rail 188 moves arm 192, thereby actuating switch 190 to stop motor 126, activate an alarm, or both.

Figure 10A:
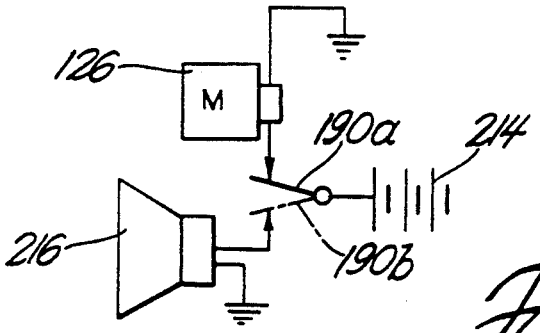
FIG. 10A shows a circuit by which the switch in FIG. 10 controls a motor on the basket assembly.

In FIG. 10A is shown an example of a circuit of which switch 190 can be part, the switch having a first position at 190*a* and a second position at 190*b*. Position 190*a* is associated with the FIG. 10 position of rail 108 during which electrical power from source has an unbroken path to motor 126 and motor 126 continues to run. No power flows to alarm 216 during position 190*a* of switch 190 or the FIG. 10 position of rail 188. When an obstacle swings rail 188 sufficiently counterclockwise from its FIG. 10 position, switch 190 moves to position 190*b*, whereupon motor 126 stops and alarm 216 is energized. Switch 190 can be a mechanically bistable switch wherein the switch can rest at position 190*a* or 190*b* but at no position therebetween.

I wish it to be understood that I do not desire to be limited to the exact details of construction shown and described herein since obvious modifications will occur to those skilled in the relevant arts without departing from the spirit and scope of the following claims.

I claim:

1. An apparatus having a raisable, expandable basket assembly for use as a mobile work platform, the apparatus comprising:

a base;

a relatively fixed basket subassembly of the basket assembly;

a relatively mobile basket subassembly telescopingly translatable from the fixed basket subassembly to expand the basket assembly, the relatively mobile basket subassembly having one position where it is fully retracted with respect to the relatively fixed basket subassembly, the relatively mobile basket subassembly having another position where it is fully extended with respect to the relatively fixed basket subassembly;

an underframe upon which the relatively fixed subassembly is stationarily mounted;

a first arm pivotally connected to the base and pivotally connected to the underframe, the first arm pivotable about a first axis on the base;

a second arm pivotally connected to the base and pivotally connected to the underframe, the second arm pivotable about a second axis on the base;

a raising means for swinging the basket assembly up and down, the raising means pivotable about a third axis on the base;

a translation drive means for translating the relatively mobile basket subassembly from the relatively fixed basket subassembly, the translation drive means connected to the underframe and the relatively mobile basket subassembly;

a first fence on the relatively fixed basket subassembly;

a second fence on the relatively mobile basket subassembly;

a tube on one of the fences, the tube disposed parallel to a translational path of the relatively mobile basket subassembly;

a fence rail on another of the fences, the fence rail closely and slidably fit within the tube;

wherein during the fully retracted position, one end of the fence rail extends from the tube by a distance at least as long as the translational path.

2. The apparatus of claim 1 further comprising:

an adjustable stairway parallel to the first arm and second arm, the adjustable stairway swingably connected to the base about a fourth axis and connected to the relatively fixed basket assembly;

steps connected to the adjustable stairway such that the steps remain substantially horizontal as the adjustable stairway swings about the fourth axis.

3. The apparatus of claim 2 further comprising;

a fixed-position stairway on the base;

a fixed work platform on the base disposed at an upper end of the fixed-position stairway and at a lower end of the adjustable stairway.

4. The apparatus of claim 1 further comprising an underlying support frame for the relatively mobile basket subassembly, the support frame translatably engaged to the underframe of the relatively fixed basket subassembly.

5. The apparatus of claim 4 wherein the underlying support frame comprises:

parallel beams translatably engaged to the underframe at opposing sides of the underframe;

a cross piece connected between the beams;

wherein one end of the translation drive means is connected to the cross piece.

6. The apparatus of claim 4 wherein the translation drive means is disposed completely within a space bordered by the beams and the cross piece.

7. The apparatus of claim 1, further comprising:

parallel beams of the relative mobile basket subassembly, the beams translatably engaged to the underframe at opposing sides of the underframe;

a cross piece fixed between the beams;

a generally planar floor element on the relatively fixed basket subassembly;

a plurality of elongate walls fixed to the floor element;

a border panel along one edge of the planar floor element facing the cross piece, the border panel defining a row of apertures therealong;

elongate floor elements of the relatively mobile basket subassembly, the elongate floor elements fixed to the cross piece and extending through the apertures of the border panel into interdigitated relation with the elongated walls.

8. An apparatus having a raisable, expandable basket assembly for use as a mobile work platform, the apparatus comprising:

a base;

a relatively fixed basket subassembly of the basket assembly;

a relatively mobile basket subassembly telescopingly translatable from the fixed basket subassembly to expand the basket assembly;

an underframe upon which the relatively fixed subassembly is stationarily mounted;

a first arm pivotally connected to the base and pivotally connected to the underframe, the first arm pivotable about a first axis on the base;

a second arm pivotally connected to the base and pivotally connected to the underframe, the second arm pivotable about a second axis on the base;

a raising means for swinging the basket assembly up and down, the raising means pivotable about a third axis on the base;

a translation drive means for translating the relatively mobile basket subassembly from the relatively fixed basket subassembly, the translation drive means connected to the underframe and the relatively mobile basket subassembly;

parallel I-beams of the relatively mobile basket subassembly translatably engaged to the underframe at opposing sides of the underframe, the parallel I-beams translating in a first, forward direction to expand the basket assembly and translating in a second, rearward direction to contract the basket assembly;

rollers engaging the I-beams;

mounting means for rotatably joining the rollers to the relatively fixed basket subassembly, the mounting means having a front and a rear and being disposed along the opposing sides of the underframe and along the I-beams;

forward rollers at the front of the mounting means under flanges of the I-beams;

intermediate rollers between the front and rear of the mounting means under the flanges of the I-beams;

interflange rollers between upper flanges of the I-beams and lower flanges of the I-beams, the interflange rollers disposed longitudinally between the forward rollers and the intermediate rollers;

rearward rollers at the rear of the mounting means atop the I-beams.

9. The apparatus of claim 8 wherein the mounting means is comprised of a pair of frame members fixed along the opposing sides of the underframes, whereby the mounting means strengthens the underframe.

10. An apparatus having a raisable, expandable basket assembly for use as a mobile work platform, the apparatus comprising:

a base;

a relatively fixed basket subassembly of the basket assembly;

a relatively mobile basket subassembly telescopingly translatable from the fixed basket subassembly to expand the basket assembly;

an underframe upon which the relatively fixed subassembly is stationarily mounted;

a first arm pivotally connected to the base and pivotally connected to the underframe, the first arm pivotable about a first axis on the base;

a second arm pivotally connected to the base and pivotally connected to the underframe, the second arm pivotable about a second axis on the base;

a raising means for swinging the basket assembly up and down, the raising means pivotable about a third axis on the base;

a translation drive means for translating the relatively mobile basket subassembly from the relatively fixed basket subassembly, the translation drive means connected to the underframe and the relatively mobile basket subassembly;

a bumper swingably connected to a forward portion of the relatively mobile basket subassembly;

a switch mechanically engaging the bumper, the switch opening and closing in response to the rotational position of the bumper;

means in series with the translation drive means to stop the translation drive means in response to a selected position of the switch.

11. The apparatus of claim 10 wherein:

the bumper is biased toward a first rotational position by gravity;

a spring connected to the bumper biases the bumper away from the first rotational position toward a second rotational position;

the bumper opens the switch during one of the rotational positions;

the bumper closes the switch during another of the rotational positions.

12. The apparatus of claim 10 wherein the translation means is an electric motor in series with the switch.

13. An apparatus having a raisable, expandable basket assembly for use as a mobile work platform, the apparatus comprising:

a base;

a relatively fixed basket subassembly of the basket assembly;

a relatively mobile basket subassembly telescopingly translatable from the fixed basket subassembly to expand the basket assembly;

an underframe upon which the relatively fixed subassembly is stationarily mounted;

a first arm pivotally connected to the base and pivotally connected to the underframe, the first arm pivotable about a first axis on the base;

a second arm pivotally connected to the base and pivotally connected to the underframe, the second arm pivotable about a second axis on the base;

a raising means for swinging the basket assembly up and down, the raising means pivotable about a third axis on the base;

a translation drive means for translating the relatively mobile basket subassembly from the relatively fixed basket subassembly, the translation drive means connected to the underframe and the relatively mobile basket subassembly;

parallel beams of the relatively mobile basket subassembly translatably engaged to the underframe;

a first fence fixedly connected to the underframe;

a second fence fixedly connected to at least one of the parallel beams;

one of the fences having a tube disposed parallel to a translational path of the relatively mobile basket subassembly;

another of the fences having a fence rail closely and slidably fit in the tube;

a generally planar floor element fixed on the underframe;

a plurality of elongate walls fixed to the floor element;

a border panel fixed along one edge of the planar floor element, the border panel defining a row of apertures;

elongate floor elements fixed relative to the parallel beams, the elongate floor elements extending through the apertures of the border panel into interdigitated relation with the elongate walls.

* * * * *